US009702052B2

(12) United States Patent
Nishikawa et al.

(10) Patent No.: US 9,702,052 B2
(45) Date of Patent: Jul. 11, 2017

(54) FORMING METHOD OF THERMAL INSULATION FILM

(71) Applicants: TOYOTA JIDOSHA KABUSHIKI KAISHA, Toyota-shi, Aichi-ken (JP); KABUSHIKI KAISHA TOYOTA CHUO KENKYUSHO, Nagakute-shi, Aichi-ken (JP)

(72) Inventors: Naoki Nishikawa, Toyota (JP); Masaaki Tani, Nagakute (JP); Hiroshi Hohjo, Nagakute (JP)

(73) Assignees: TOYOTA JIDOSHA KABUSHIKI KAISHA, Aichi-ken (JP); KABUSHIKI KAISHA TOYOTA CHUO KENKYUSHO, Nagakute-shi (JP)

( * ) Notice: Subject to any disclaimer, the term of this patent is extended or adjusted under 35 U.S.C. 154(b) by 0 days.

(21) Appl. No.: 14/933,599

(22) Filed: Nov. 5, 2015

(65) Prior Publication Data

US 2016/0130716 A1 May 12, 2016

(30) Foreign Application Priority Data

Nov. 7, 2014 (JP) ..... 2014-226775

(51) Int. Cl.

| | |
|---|---|
| ***C23C 28/00*** | (2006.01) |
| ***C25D 11/18*** | (2006.01) |
| ***C25D 11/04*** | (2006.01) |
| ***C25D 11/24*** | (2006.01) |

(52) U.S. Cl.

CPC ..... *C25D 11/18* (2013.01); *C25D 11/04* (2013.01); *C25D 11/246* (2013.01)

(58) Field of Classification Search

CPC ..... C23C 28/00
USPC ..... 205/201, 203, 204
See application file for complete search history.

(56) References Cited

U.S. PATENT DOCUMENTS

| | | | | |
|---|---|---|---|---|
| 2005/0196606 | A1* | 9/2005 | Ihara | G11B 5/746 428/323 |
| 2013/0255651 | A1 | 10/2013 | Nomura et al. | |
| 2014/0190739 | A1* | 7/2014 | Zhou | H05K 5/04 174/565 |
| 2014/0193607 | A1* | 7/2014 | Browning | C25D 11/04 428/138 |

(Continued)

FOREIGN PATENT DOCUMENTS

| | | | |
|---|---|---|---|
| CN | 103842560 | A | 6/2014 |
| JP | 58-192949 | A | 11/1983 |

(Continued)

*Primary Examiner* — Edna Wong
(74) *Attorney, Agent, or Firm* — Sughrue Mion, PLLC

(57) ABSTRACT

A forming method of a thermal insulation film, including: a first step of forming an anode oxidation coating film on an aluminum-based wall surface, the anode oxidation coating film including micro-pores each having a diameter of micrometer-scale and nano-pores each having a diameter of nanometer-scale; a second step of abrading a surface of the anode oxidation coating film with abrasive powders and bringing the abrasive powders into the micro-pores located at the formed abraded surface; and a third step of forming a protection film on the abraded surface to produce a thermal insulation film including the anode oxidation coating film and the protection film.

7 Claims, 11 Drawing Sheets

(56) References Cited

U.S. PATENT DOCUMENTS

2014/0245994 A1 9/2014 Nishikawa et al.

FOREIGN PATENT DOCUMENTS

JP 2012-072745 A 4/2012
JP WO 2013038249 A2 * 3/2013 ..... C25D 11/246

* cited by examiner

-- Conventional --

-- Conventional --

FORMING METHOD OF THERMAL INSULATION FILM

INCORPORATION BY REFERENCE

The disclosure of Japanese Patent Application No. 2014-226775 filed on Nov. 7, 2014 including the specification, drawings and abstract is incorporated herein by reference in its entirety.

BACKGROUND OF THE INVENTION

1. Field of the Invention

The invention relates to a forming method of a thermal insulation film which is formed on e.g. a wall surface of an internal combustion engine that is located in a combustion chamber.

2. Description of Related Art

An internal combustion engine, such as gasoline engine, diesel engine, and the like, is mainly composed of a cylinder block, a cylinder head, and a piston, and its combustion chamber is delimited by a surface of a bore of the cylinder block, a top surface of the piston inserted in the bore, a bottom surface of the cylinder head, and top surfaces of an intake valve and an exhaust valve provided in the cylinder head. As high output from the internal combustion engine is increasingly demanded recently, it becomes important to reduce its cooling loss. As one of the solutions to reduce the cooling loss, a method may be proposed in which a thermal insulation film formed by ceramics is formed on an inner wall of the combustion chamber.

However, the above ceramics generally has low thermal conductivity and high thermal capacity, thus steady rise of the surface temperature may incur reduction of intake efficiency and knocking (abnormal combustion caused by heat accumulated in the combustion chamber), and therefore the material as the thermal insulation film for the inner wall of the combustion chamber has not been widely used.

Therefore, it is desirable that the thermal insulation film formed on the wall surface of the combustion chamber is formed by material which not only is heat resistant and heat insulative, but also has low thermal conductivity and low thermal capacity. That is, in order to lower the temperature of the wall surface by following temperature of fresh gas during the intake stroke, it is preferable to have low thermal capacity, so that the temperature of the wall surface would not be steadily raised. Moreover, in addition to the low thermal conductivity and low thermal capacity, it is also desirable that the thermal insulation film is formed by material which can withstand explosion pressure in the combustion chamber upon combustion, injection pressure, and repeated stresses caused by thermal expansion and thermal contraction, and has high adherence with base material of the cylinder block and the like.

Here, attention is directed to published prior art. Japanese Patent Application Publication No. 58-192949 (JP 58-192949 A) discloses a piston and a manufacturing method therefor, wherein an alumite layer is formed on a top surface of the piston, and a ceramic layer is formed on a surface of the alumite layer. With this piston, its heat resistance and thermal insulation are made excellent by forming the alumite layer on the top surface.

As such, by forming the alumite layer (anode oxidation coating film) on a wall surface of an internal combustion engine that is located in the combustion chamber, it is possible to form an internal combustion engine having excellent thermal insulation, low thermal conductivity, and low thermal capacity. Also, in addition to these properties, it has excellent swing property which is also important performance required by an anode oxidation coating film. Here, "swing property" means that the anode oxidation coating film has thermal insulation performance and its temperature follows temperature of the gas in the combustion chamber.

When being observed microscopically, the above anode oxidation coating film takes a structure having a plurality of adjacent cells, and has a lot of cracks on its surface, wherein a portion of the cracks extend inwardly (that is, extend in thickness direction or approximately in thickness direction of the anode oxidation coating film). There are also lots of internal defects within the film that extend in directions other than the thickness direction (horizontal direction orthogonal to the thickness direction or approximately the horizontal direction). Moreover, it is known that these cracks and internal defects are micro-pores each having a diameter (or maximum diameter in cross sectional dimensions) of micrometer-scale approximately ranging from 1 μm to several tens of μm. Furthermore, the "cracks" stem from crystalline matter of aluminum alloy for casting.

Moreover, inside the anode oxidation coating film, in addition to the above cracks and internal defects of micrometer-scale, there are also many small pores each having a diameter of nanometer-scale (nano-pores), and generally, the nano-pores are also present in a state where they extend from the surface of the anode oxidation coating film in its thickness direction or approximately in the thickness direction. Furthermore, the "nano-pores" stem from anode oxidation treatment and are arranged regularly.

As such, the formed anode oxidation coating film generally includes therein micro-pores such as surface cracks, internal defects or the like having a diameter or maximum dimension in cross-section of micrometer-scale, and a plurality of nano-pores of nanometer-scale.

However, if the surface roughness of the thermal insulation film constructed by the above anode oxidation coating film is large, abnormal combustion may be easily incurred, resulting in degradation in fuel efficiency. Therefore, in order to lower the surface roughness of the thermal insulation film constructed by the anode oxidation coating film, generally the surface is abraded. At this time, since the anode oxidation coating film has a plurality of micro-pores therein as described above, there is the issue that the smoothness of the surface of the thermal insulation film cannot be improved due to appearance of internal micro-pores on the surface even after repeated abrasion. This will be described with reference to FIG. 10 and FIG. 11.

As shown in FIG. 10, a thermal insulation film M constructed by an anode oxidation coating film is formed on a wall surface W of a cylinder block, etc. constituting an internal combustion engine. The thermal insulation film M has a plurality of micro-pores Pm each having a diameter dm of micrometer-scale and a plurality of nano-pores Pn each having a diameter do of nanometer-scale. Although the micro-pores and the nano-pores are exposed at the surface of the thermal insulation film, since in particular the micro-pores Pm having a larger diameter dm are exposed, the surface roughness becomes large. Therefore, even if the surface is abraded in order to improve its smoothness, as shown in FIG. 11, the smoothness of the surface cannot be improved so long as the micro-pores Pm inside the thermal insulation film M are exposed.

Here, in Japanese Patent Application Publication No. 2012-72745 (JP 2012-72745 A), a thermal insulation structure is disclosed, wherein a porous layer is formed on a surface of a base material made from aluminum alloy by anode oxidation treatment, and a covering layer having lower thermal conductivity than the base material is provided on the porous layer. By way of the anchor effect brought by surface unevenness of the porous layer, adherence of the porous layer with the covering layer is improved. However, since the surface of the porous layer (anode oxidation coating film) has unevenness, despite the covering layer provided on the porous layer, the surface unevenness may be largely reflected at the surface of the covering layer, so surface roughness of the thermal insulation film constructed by the porous layer and the covering layer cannot be improved.

SUMMARY OF THE INVENTION

The invention provides a forming method of a thermal insulation film, which is capable of effectively reducing surface roughness of the thermal insulation film that includes an anode oxidation coating film having a plurality of micro-pores.

A forming method of thermal insulation film according to a first aspect of the invention includes the following steps: a first step of forming an anode oxidation coating film on an aluminum-based wall surface, the anode oxidation coating film including micro-pores each having a diameter of micrometer-scale and nano-pores each having a diameter of nanometer-scale; a second step of abrading a surface of the anode oxidation coating film with abrasive powders and bringing the abrasive powders into the micro-pores located at the formed abraded surface; and a third step of forming a protection film on the abraded surface to produce a thermal insulation film including the anode oxidation coating film and the protection film.

The forming method of thermal insulation film according to the above aspect is a method for forming the thermal insulation film on an aluminum-based wall surface, for example, a top surface of a piston, a cylinder block, and so on constituting the combustion chamber, and is characterized in that after the anode oxidation coating film is formed on the aluminum-based wall surface, abrasive powders are used in abrading its surface, and the abrasive powders used at the time of abrading are brought into the micro-pores at the abraded surface that is formed by abrading. By bringing the abrasive powders into the micro-pores at the abraded surface, the micro-pores are filled by the abrasive powders, and the surface roughness of the abraded surface is reduced. By forming the protection film on the abraded surface in this state, it is possible to prevent the abrasive powders from falling off from the micro-pores, and thus the thermal insulation film having low surface roughness can be formed.

Here, "micro-pores" collectively refers to cracks each having a diameter of micrometer-scale and extending inwardly from the surface of the anode oxidation coating film, and internal defects not located at the surface of the anode oxidation coating film but present inside the coating film. In addition, in the present specification, "diameter" of the micro-pores, nano-pores, or the like means the nominal diameter in the case of cylindrical shape, and the length of the longest side in the cross-section in the case of elliptically columnar shape or prismatic shape. Therefore, for pores in the shapes other than cylindrical shape, "diameter" is regarded as a diameter of an equivalent circle having the same area.

In addition, according to the inventors, the diameter or maximum size in cross-section of the micro-pores of micrometer-scale included in the anode oxidation coating film formed on the wall surface of the internal combustion engine that is located in the combustion chamber is determined to be generally in an range from about 1 μm to several tens of μm, and the diameter or maximum size in cross-section of the nano-pores of nanometer-scale is determined to be generally in a range from about 10 to 100 nm. Furthermore, determination of the above range from 1 μm to several tens of μm and that from 10 to 100 nm can be carried out by extracting some micro-pores, nano-pores in a certain area with respect to SEM image photograph data, TEM image photograph data of the cross-section of the anode oxidation coating film, measuring the diameters or maximum sizes thereof, and averaging the respective measurements.

In the case where the surface of the anode oxidation coating film is abraded by abrasive powders, in a conventional abrading method, generally the abrasive powders entering the micro-pores at the abraded surface are washed and removed. In the forming method according to the invention, the conventional concept of washing and removing the abrasive powders has been reconsidered, and a method in which the abrasive powders entering the micro-pores are kept as they were, in other words, the abrasive powders are actively brought into the micro-pores is used, and by filling the micro-pores at the abraded surface with the abrasive powders, the surface roughness of the abraded surface can be reduced.

Furthermore, as a method bringing the abrasive powders into the micro-pores at the abraded surface in the second step, in addition to making the abrasive powders automatically enter the micro-pores during formation of the abraded surface with the abrasive powders, it is also possible to use a method in which after the abraded surface is formed by the abrading process, filling process of the abrasive powders is performed so as to bring the abrasive powders into the micro-pores at the abraded surface, that is, a method in which filling process of the abrasive powders is performed separately from the abrading process.

In the third step, the protection film is formed on the abraded surface, and the thermal insulation film constructed by the anode oxidation coating film and the protection film is formed, so that the abrasive powders respectively entering the plurality of micro-pores at the abraded surface are prevented from falling off from the micro-pores after the abrasive powders enter the micro-pores.

If the protection film is formed on the abraded surface of the anode oxidation coating film, although the abrasive powders enter the micro-pores at the abraded surface to fill the pores, material, e.g. in liquid state, for forming the protection film can still permeate into the micro-pores at the abraded surface. In addition, the material for forming the protection film may also permeate into the nano-pores which are located at the abraded surface but are not entered by the abrasive powders, and a certain range from the abraded surface of the nano-pores up to a certain depth may be sealed by the material for forming the protection film. Also, the micro-pores present inside the anode oxidation coating film but not exposed at the abraded surface is not permeated by the material for forming the protection film, and thus are kept as they were as air voids.

As such, the formed thermal insulation film has a predefined porosity by maintaining air voids of the micro-pores that are present inside the anode oxidation coating film as a constituting component thereof, and thus becomes a thermal insulation film having good thermal insulation and low thermal capacity. In addition, the surface roughness of the abraded surface of the anode oxidation coating film located inside (at the aluminum-based wall surface side) of the protection film is small, therefore the thermal insulation film has a reduced surface roughness, and becomes a thermal insulation film having high smoothness.

Here, it is preferable that the micro-pores at the abraded surface formed in the second step have a depth in the range from 1 to 10 μm, and the abrasive powders have an average particle size in a range below 1 μm.

By setting the lower limit of the depth of the micro-pores at the abraded surface to be 1 μm and setting the average particle size of the abrasive powders to be below the lower limit, 1 μm, of the depth of the micro-pores, it is possible to suppress the abrasive powders entering the micro-pores from protruding out from the micro-pores to impair the smoothness of the abraded surface, and it is possible to make the micro-pores and the abrasive powders contact with each other according to their size specifications, so as to suppress the abrasive powders from falling off from the micro-pores. In addition, if the micro-pores are too large to be fully filled with the abrasive powders, there may be unevenness remained.

Here, the "average particle size of the abrasive powders" indicates an average value of the particle sizes calculated by selecting a prescribed amount of abrasive powders from the abrasive powders to be used, measuring particle sizes or maximum sizes of the abrasive powders, and dividing the sum of the measurement results by the number of the samples. In addition, the average particle size of the abrasive powders is preferable to be above 100 nm.

In the case where the depth of the micro-pores at the abraded surface is in the range from 1 to 10 μm, by setting the average particle size of the abrasive powders to be above 100 nm, namely 0.1 μm, although the abrasive powders can enter the micro-pores, generally it is difficult for the abrasive powders to enter the nano-pores each having a diameter ranging from 10 to 100 nm. Therefore, it is possible to eliminate the situation in which the abrasive powders enter and fill the nano-pores, so that the material, e.g. in liquid state, for forming the protection film can permeate into the nano-pores to a prescribed depth to seal the nano-pores.

In addition, in the third step, it is preferable that the protection film is formed by coating a polymer containing Si on the abraded surface and firing the polymer to convert it into silicon dioxide.

Here, as a "polymer containing Si", polysiloxane, polysilazane, etc. may be enumerated. By using them, it is possible for the polymer containing Si to smoothly permeate into the nano-pores of nanometer-scale, convert into silicon dioxide at a relatively low temperature, become a solidified body (e.g. silica glass) having high hardness after solidifying, and achieve improvement in the strength of the anode oxidation coating film.

Moreover, polysiloxane and polysilazane not only function to form the protection film on the abraded surface to seal the nano-pores, but also can act as adhesive to permeate into the micro-pores at the abraded surface so that the abrasive powders entering the micro-pores can be adhered to each other, and thus the abrasive powders are prevented from falling off.

In addition, the invention is not specifically limited to the method of coating the polymer containing Si, and a method of impregnating the anode oxidation coating film into the polymer containing Si, etc. may be used.

The internal combustion engine having the aluminum-based wall surface as the object on which the thermal insulation film is formed by using the forming method according to the above aspect may be either of a gasoline engine and a diesel engine, which, as mentioned above, is mainly constructed by an engine cylinder block, a cylinder head and a piston, and a combustion chamber of which is delimited by a surface of a bore of the cylinder block, a top surface of the piston inserted in the bore, a bottom surface of the cylinder head, and top surfaces of an intake valve and an exhaust valve provided in the cylinder head. Moreover, the formed thermal insulation film may be formed on all the wall surfaces of the combustion chamber, and may also be formed on a portion thereof. In the latter, embodiments in which the coating film is formed only on the top surface of the piston, only on the bottom surface of the cylinder head, or only on the top surfaces of the valves may be enumerated.

As can be appreciated from the above description, by using the forming method of thermal insulation film according to the aspects of the invention, an anode oxidation coating film is formed on an aluminum-based wall surface, and abrasive powders are used to abrade a surface of the anode oxidation coating film and are brought into micro-pores at the abraded surface formed by abrading, thereby it is possible to fill the micro-pores with the abrasive powders and reduce the surface roughness of the abraded surface, and therefore, it is possible to form a thermal insulation film having low surface roughness.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, embodiments of the forming method of thermal insulation film according to the invention will be described with reference to the accompanying drawings.

Embodiments of the Forming Method of Thermal Insulation Film

Figure 1:
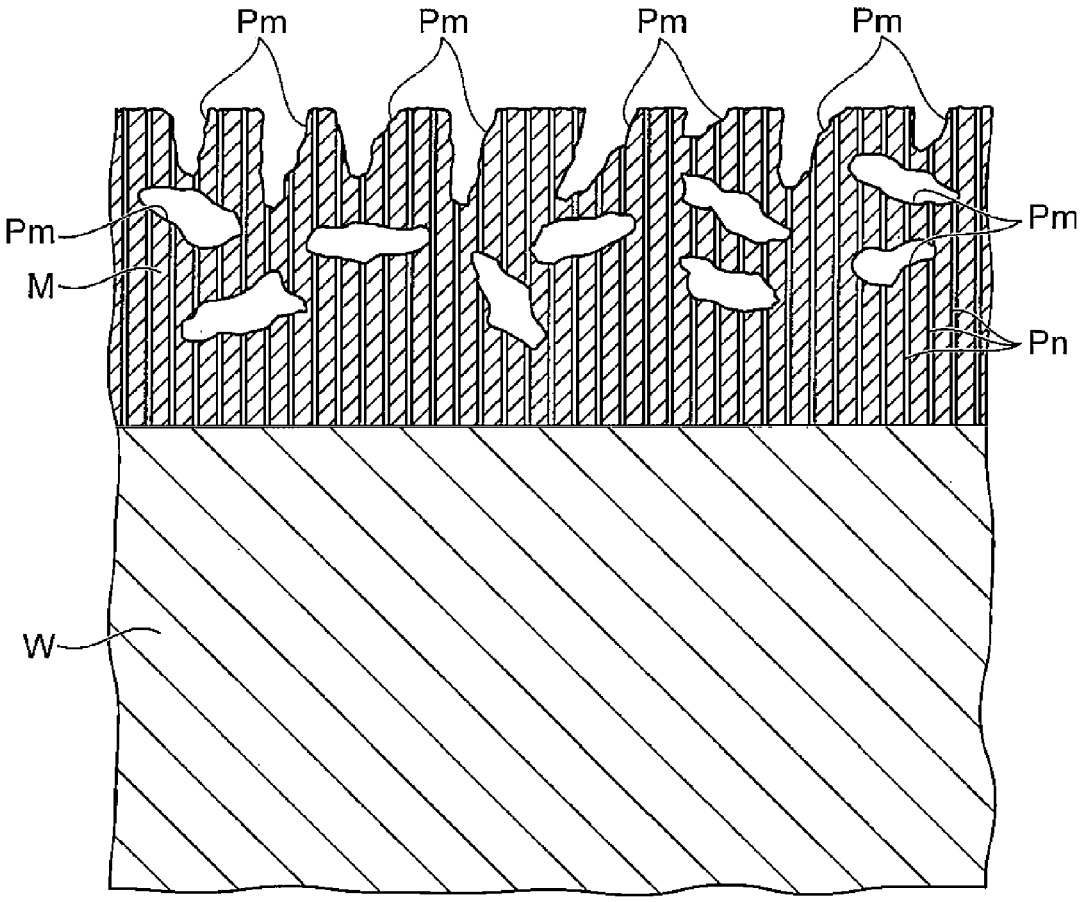
FIG. 1 is a schematic diagram illustrating the first step of the forming method of thermal insulation film according to the invention.
Figure 2:
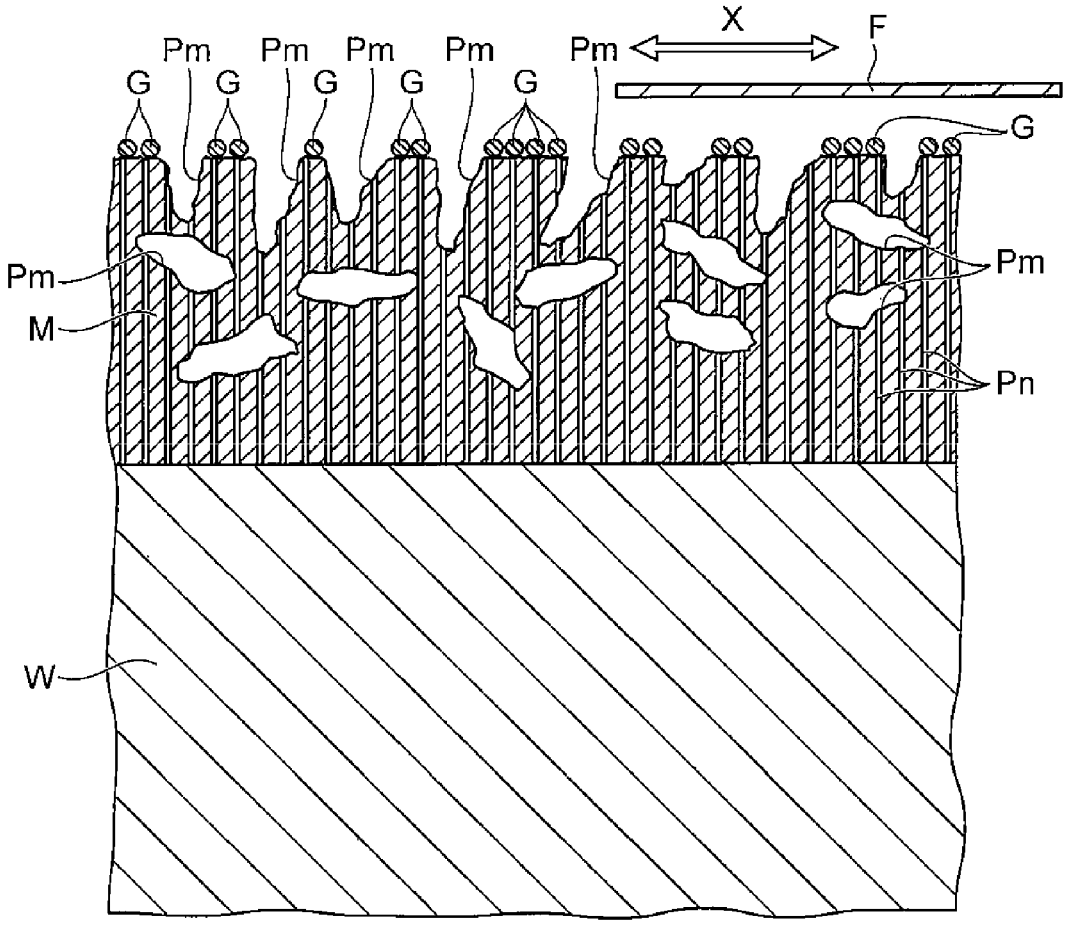
FIG. 2 is a schematic diagram illustrating the second step of the forming method of thermal insulation film.
Figure 3:
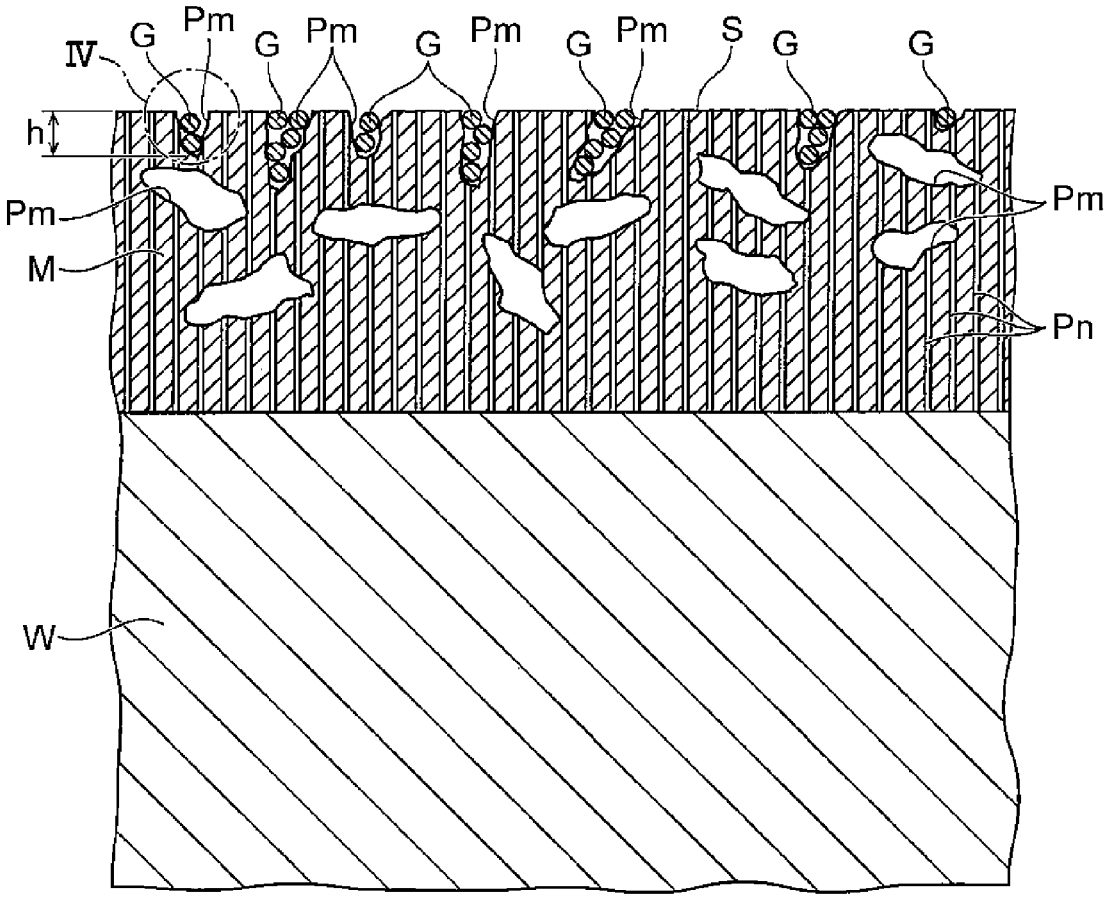
FIG. 3 is a schematic diagram illustrating the second step of the forming method of thermal insulation film subsequent to FIG. 2.
Figure 5:
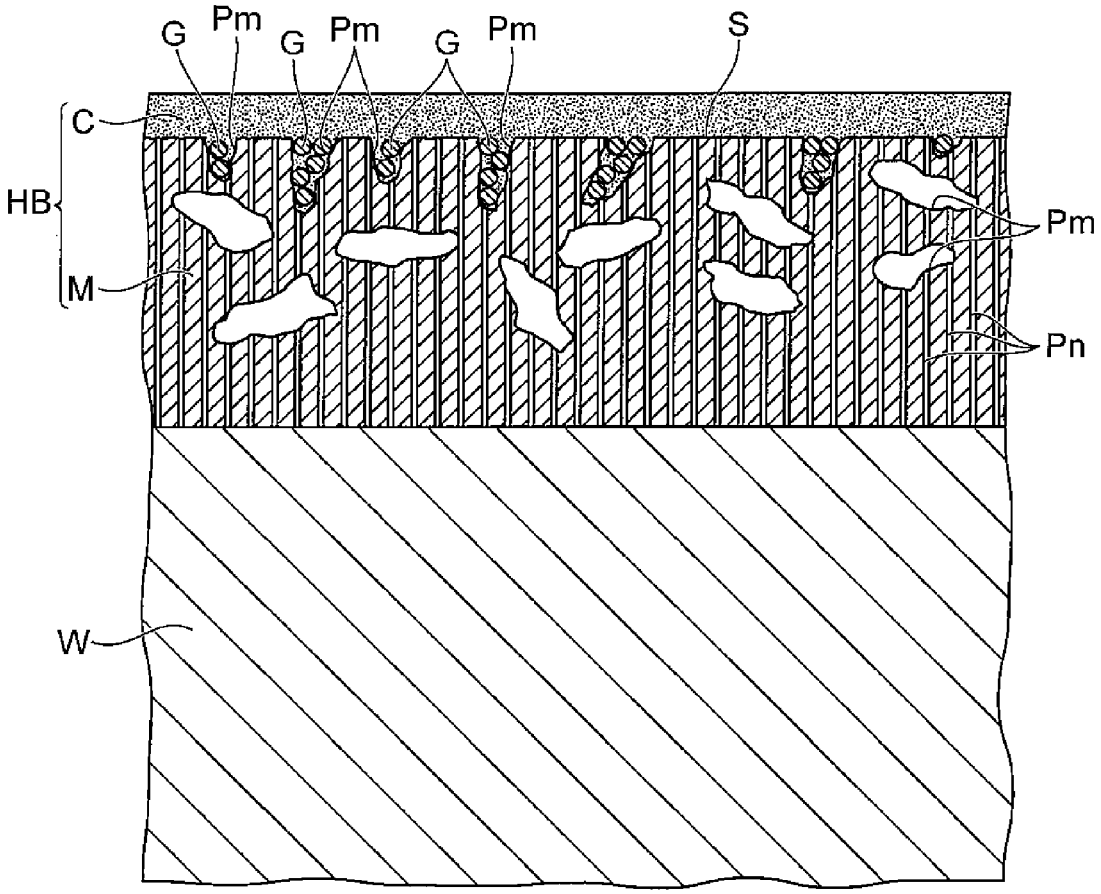
FIG. 5 is a schematic diagram illustrating the third step of the forming method of thermal insulation film.

FIG. 1 is a schematic diagram illustrating the first step in the forming method of thermal insulation film according to the invention. FIG. 2 and FIG. 3 are schematic diagrams sequentially illustrating the second step. FIG. 5 is a schematic diagram illustrating the third step.

Firstly, as shown in FIG. 1, an anode oxidation coating film M is formed on a surface of an aluminum-based wall surface W (first step). For the aluminum-based wall surface W, it may be enumerated aluminum or alloy thereof, material formed by plating iron-based material with aluminum and subjecting to anode oxidation treatment, and so on, wherein the anode oxidation coating film M formed on the wall surface having aluminum or aluminum alloy as base material becomes alumite.

As shown in FIG. 1, when the anode oxidation coating film M formed on the surface of the aluminum-based wall surface W is microscopically observed, there are micro-pores Pm (longitudinal cracks) extending in the thickness direction or approximately in the thickness direction of the anode oxidation coating film M and each having a diameter of micrometer-scale on the surface of the anode oxidation coating film, and there are additional micro-pores Pm (internal defects) extending in the horizontal direction or approximately in the horizontal direction of the anode oxidation coating film M and each having a diameter of micrometer-scale at the inside of the anode oxidation coating film.

Moreover, among these micro-pores Pm, the diameter or maximum size in cross-section of the micro-pores Pm is about in a range from 1 μm to several tens of μm. Furthermore, not only in the case of normal aluminum alloy, but also in the case where the aluminum alloy further contains any of Si, Cu, Mg, Ni, and Fe, the diameter or size in cross-section of the micro-pores Pm tends to further increase.

Furthermore, as shown in FIG. 1, at the inside of the anode oxidation coating film M, in addition to the micro-pores Pm of micrometer-scale, there are also a plurality of small pores of nanometer-scale (nano-pores Pn), and similar to the micro-pores Pm, the nano-pores Pn also extend in the thickness direction or approximately in the thickness direction of the anode oxidation coating film M. Moreover, the diameter or maximum size in cross-section of the nano-pores Pn is about in the range from 10 to 100 nm.

Next, as shown in FIG. 2, a surface of the anode oxidation coating film M is abraded (in a abrading direction) with abrasive powders G by an abrasive cloth F. By abrading the surface of the anode oxidation coating film M to a prescribed depth, an abraded surface S is formed as shown in FIG. 3, and the abrasive powders G are brought into the micro-pores Pm at the abraded surface S (second step). Here, as the method for bringing the abrasive powders G into the micro-pores Pm, in addition to making the abrasive powders G automatically enter the micro-pores Pm during formation of the abraded surface S with the abrasive powders G, it is also possible to use a method in which after the abraded surface S is formed by the abrading process, filling process of the abrasive powders is performed so as to bring the abrasive powders G into the micro-pores Pm at the abraded surface S, that is, a method in which filling process of the abrasive powders is performed separately from the abrading process.

Here, it is preferable that the abrasive powders G used are heat-resistant to over 500° C., and more preferably, use material having low thermal conductivity and low thermal capacity, and hollow glass beads, alumina may be enumerated as an example.

Figure 4:
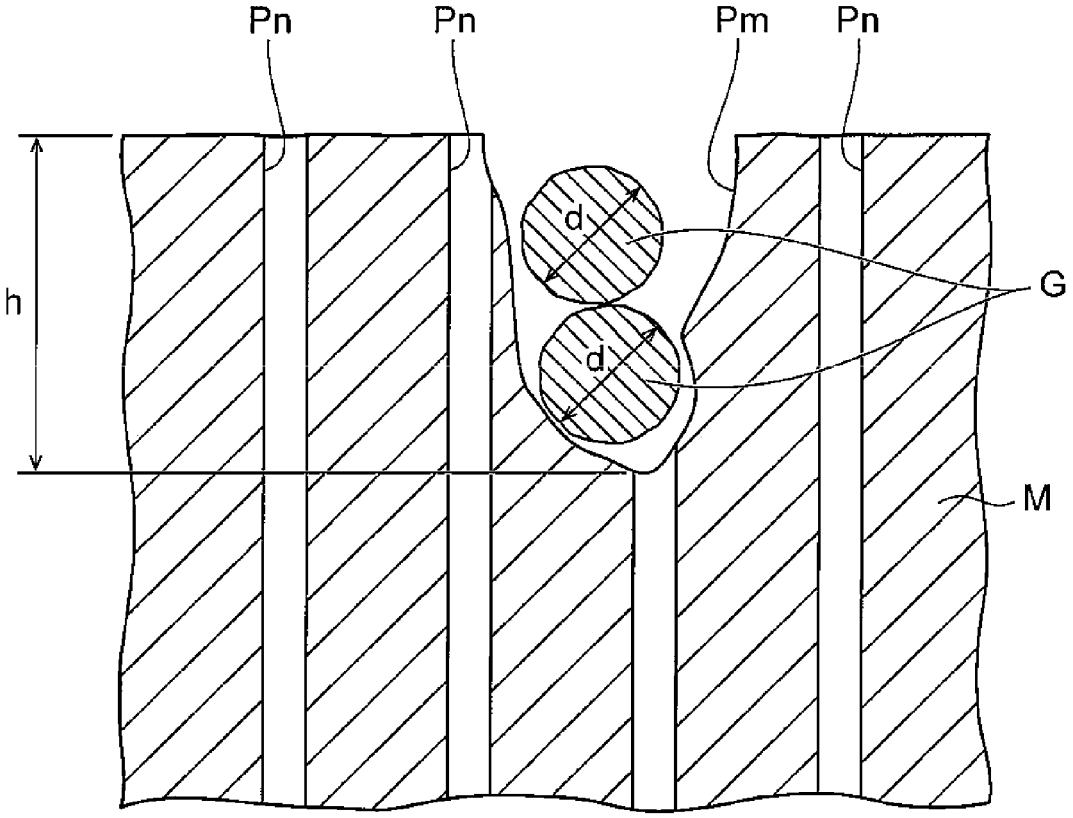
FIG. 4 is an enlarged view of the IV portion in FIG. 3.

As shown in FIG. 4 which enlarges the IV portion in FIG. 3, it is desirable that a depth h of the micro-pores Pm at the abraded surface S is larger than the average particle size d of the abrasive powders G used. For example, based on the experiments and empirical rules in the past, according to practical results etc. regarding the depth of the micro-pores Pm formed when the surface of the anode oxidation coating film M is abraded to a prescribed depth, the abrasive powders G having an average particle size less than the depth are used.

More specifically, in the case where the depth of the micro-pores Pm at the abraded surface S is in the range from 1 to 10 μm, it is preferable to use abrasive powders having an average particle size in the range above 100 nm and below 1 μm.

By setting the lower limit of the depth of the micro-pores Pm at the abraded surface S to be 1 μm and also setting the average particle size of the abrasive powders G to be below the lower limit, 1 μm, of the depth of the micro-pores Pm, it is possible to suppress the abrasive powders G entering the micro-pores Pm from diffusing out from the micro-pores Pm to impair the smoothness of the abraded surface S, and it is possible to make the micro-pores Pm and the abrasive powders G contact with each other according to their size specifications, so as to suppress the abrasive powders G from falling off from the micro-pores Pm.

Moreover, in the case where the depth of the micro-pores Pm at the abraded surface S is in the range from 1 to 10 μm, the average particle size of the abrasive powders G is above 100 nm, namely 0.1 μm, so that although the abrasive powders G can enter the micro-pores Pm, generally it is difficult for the abrasive powders to enter the nano-pores Pn having a particle size ranging from 10 to 100 nm. Therefore, it is possible to eliminate the situation in which the abrasive powders G enter and fill the nano-pores Pn, so that the material (polysilazane, etc.), e.g. in liquid state, for forming the protection film can permeate into the nano-pores to a prescribed depth to seal the nano-pores, as will be described later.

By bringing the abrasive powders G into the micro-pores Pm at the abraded surface S in the second step, it is possible to reduce the surface roughness of the abraded surface S of the anode oxidation coating film M after abrading, and it is possible to form an abraded surface S having high smoothness.

Next, as shown in FIG. 5, a polymer containing Si is coated on the abraded surface S and is subject to firing to be converted into silicon dioxide and thus to form a protection film C, so that a thermal insulation film HB constructed by the anode oxidation coating film M and the protection film C is formed.

Here, as the polymer containing Si, polysiloxane, polysilazane, etc. may be enumerated. By using them, it is possible for the polymer containing Si to smoothly permeate into the nano-pores Pn, convert into silicon dioxide at a relatively low temperature, become a solidified body such as silica glass having high hardness after solidifying, and form the protection film C in which it helps to improve the strength of the anode oxidation coating film M. Moreover, polysiloxane and polysilazane not only function to form the protection film C on the abraded surface S to seal the nano-pores Pn, but also can act as adhesive to permeate into the micro-pores Pm at the abraded surface S so that the abrasive powders G entering the micro-pores Pm can be adhered to each other.

In addition, as the coating method for the polymer containing Si, a method in which the anode oxidation coating film M is impregnated in a container receiving the polymer containing Si, a method in which the polymer containing Si is sprayed to the surface of the anode oxidation coating film M, a blade coating method, a spinning coating method, a brushing coating method, and so on may be used.

For the thermal insulation film HB as shown, since the surface of the anode oxidation coating film M has high smoothness, and the surface of the protection film C, that is, the surface of the thermal insulation film HB, has extremely high smoothness, the thermal insulation film HB may be helpful to achieve high fuel efficiency when being applied to a wall surface of components of an internal combustion engine. In addition, by maintaining air voids of the micro-pores Pm present inside the anode oxidation coating film M constituting the thermal insulation film HB, the thermal insulation film HB having a prescribed porosity can be formed, and thus has excellent thermal insulation.

Figure 6:
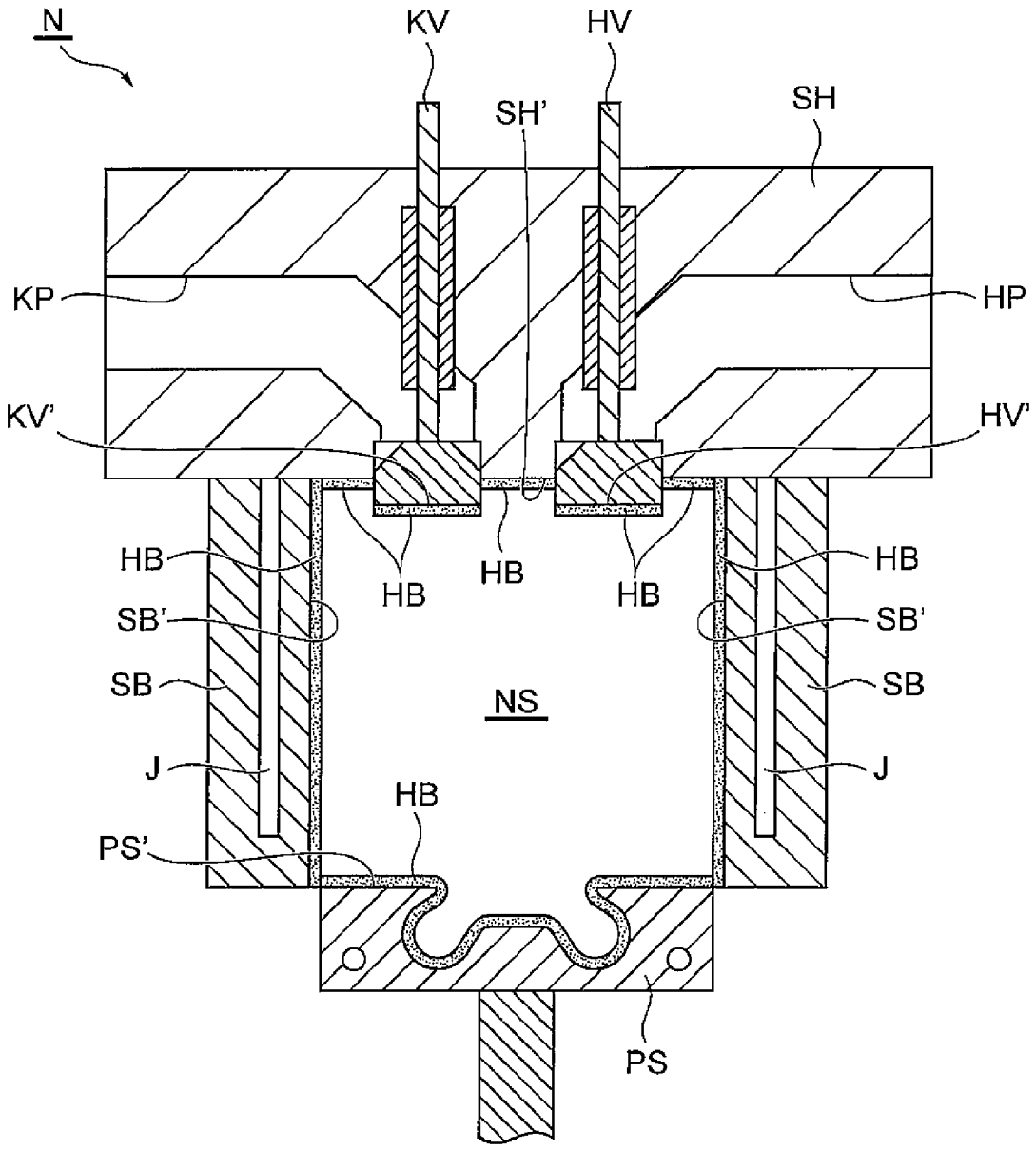
FIG. 6 is a longitudinal sectional view showing the simulation of an internal combustion engine in which a thermal insulation film is formed on all the wall surfaces of the combustion chamber.

Next, an application example of the forming method of thermal insulation film as shown will be described with reference to FIG. 6. Here, FIG. 6 simulates an internal combustion engine in which all the wall surfaces of a combustion chamber are formed with the thermal insulation film HB.

The internal combustion engine N as shown, with a diesel engine as its subject, is generally constructed by the following components: a cylinder block SB inside of which a cooling water jacket J is formed, a cylinder head SH provided on the cylinder block SB, an intake port KP and an exhaust port HP formed in the cylinder head SH as well as an intake valve KV and an exhaust valve HV mounted to be freely liftable in their respective openings in the combustion chamber NS, and a piston PS formed to be freely moved up and down in an opening below the cylinder block SB.

The components constituting the internal combustion engine N are all formed from aluminum or aluminum alloy (including high strength aluminum alloy). Moreover, especially by containing any least one of Si, Cu, Mg, Ni, and Fe in the aluminum-based material as an alloy composition, it is possible to facilitate enlargement of the opening size of the micro-pores Pm and achieve improvement of porosity.

In the combustion chamber NS delimited by the components of the internal combustion engine N, the forming method as shown is respectively applied to the wall surfaces of the combustion chamber NS (a surface SB' of the bore of the cylinder block, a bottom surface SH' of the cylinder head, a top surface PS' of the piston, and top surfaces KV', HV' of the valves), so that the thermal insulation film HB is formed on the respective wall surfaces. Furthermore, although not shown in the figures, of course, only a portion of the surfaces of the components constituting the internal combustion engine N may be formed with the thermal insulation film HB by using the forming method of thermal insulation film according to the invention.

(Experiments and Results Regarding the Surface Roughness, Cross-section Observation, and Hardness of the Thermal Insulation Film)

Respective thermal insulation films of an embodiment, a comparative example 1, and a comparative example 2 are formed by the inventors on the surface of the piston under the film formation conditions listed in Table 1, and experiments to measure the surface roughness of the thermal insulation films, observe the cross-section of the thermal insulation films, and measure the hardness of the thermal insulation films are carried out by the following experiment steps.

TABLE 1

| | Current density (mA/cm$^2$) | Film thickness after film formation (μm) | Film thickness after abrading (μm) | Particle size of abrasive powders (μm) | Protection film | Firing |
|---|---|---|---|---|---|---|
| Embodiment | 60 | 100 | 70 | 1 | Brush-coating polysilazane | 200° C. × 8 hours |
| Comparative example 1 | 60 | 100 | No abrading | — | | |
| Comparative example 2 | 60 | 100 | 70 | No abrasive powders | | |

<Experiment Steps>

(1) Preparing an experiment body formed with an anode oxidation coating film of 100 μm.

(2) Abrading by a thickness of about 25 μm with abrasive paper #1000.

(3) Abrading (by a thickness of about 5 μm) using abrasive cloth and using alumina abrasive powders of 1 μm.

(4) In the embodiment, wiping the surface gently, and drying it with a drying furnace while being kept in this state.

(5) In the comparative example 2, washing with water;

(6) Coating polysilazane with a brush. The coating is performed for several times until air bubbles generated when the nano-pores are permeated cannot be seen at the surface (about five times).

(7) Firing at 200° C. for 8 hours in a furnace.

(8) Measuring the surface roughness of the embodiment and the comparative examples 1 and 2 according to JIS B0601.

(9) Observing the cross-sections of the embodiment and the comparative examples 1 and 2.

(10) Measuring the hardness of the embodiment and the comparative examples 1 and 2.

<Experiment Results>

Measurement results regarding the surface roughness is shown in the Table 2 below and FIG. 7. In addition, the surface roughness Ra of the piston before film formation is 3 μm.

TABLE 2

| | Surface roughness Ra (μm) | Surface roughness Rz (μm) |
|---|---|---|
| Embodiment | 0.6 | 10 |
| Comparative example 1 | 5.1 | 19 |
| Comparative example 2 | 4.2 | 15 |

Figure 7:
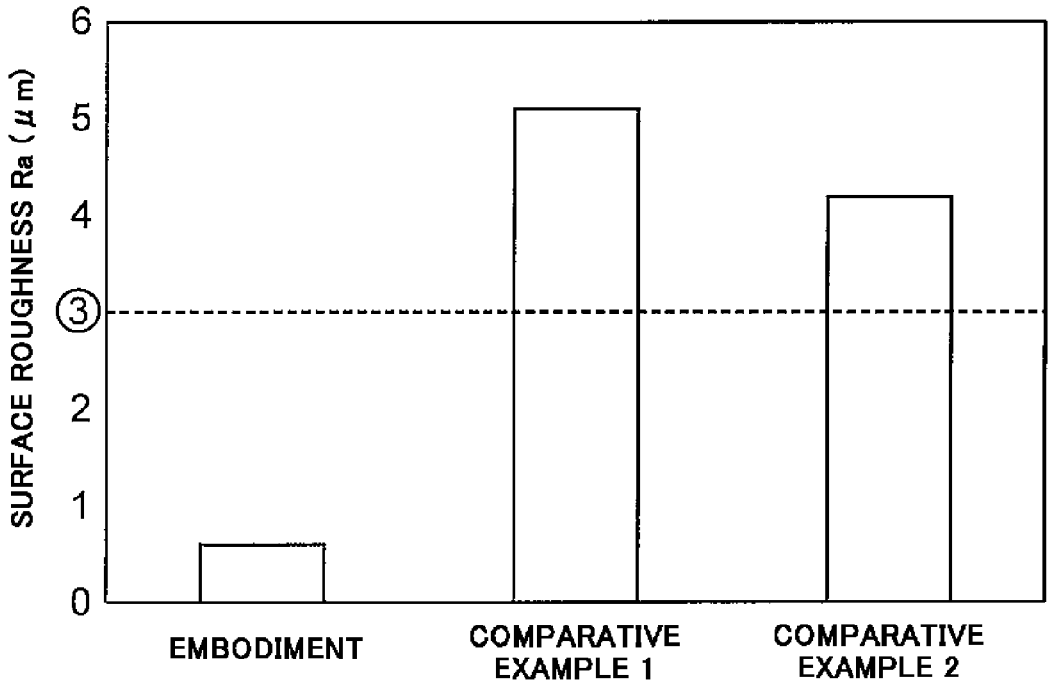
FIG. 7 is a graph showing experiment results of measuring surface roughness of the thermal insulation film.

As seen from Table 2 and FIG. 7, in comparing the comparative example 1 with the comparative example 2, although it can be observed that the surface roughness is improved to some extent by abrading the surface, since the micro-pores are exposed at the abraded surface, there are concave portions formed at the abraded surface, resulting in that the smoothness cannot be largely improved. As compared with these comparative examples 1 and 2, in the embodiment in which the abrasive powders are brought into the micro-pores exposed at the abraded surface, it is known that the surface roughness is largely improved (Ra is 0.6 μm which is below 1 μm).

Figure 8A:
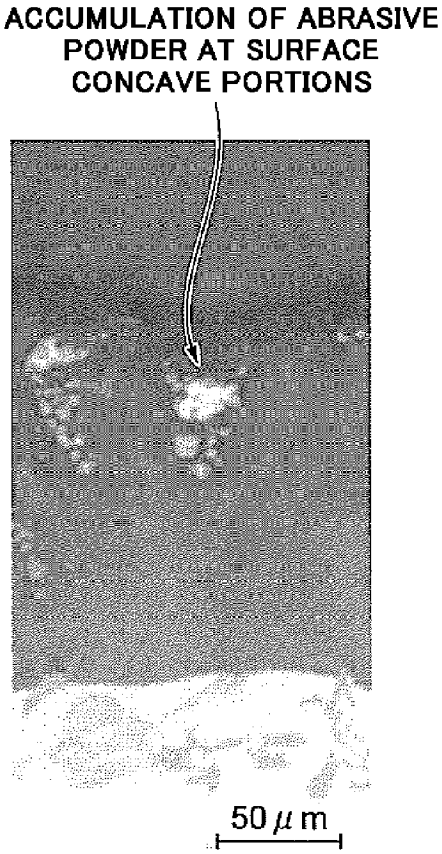
FIG. 8A shows a SEM photograph of a cross-section of thermal insulation film according to an embodiment of the invention.
Figure 8B:
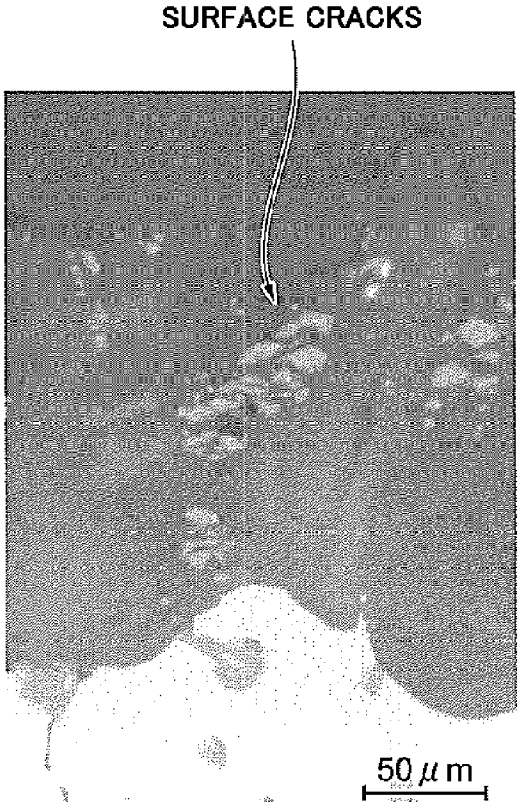
FIG. 8B shows a SEM photograph of a cross-section of thermal insulation film according to a comparative example 1.
Figure 8C:
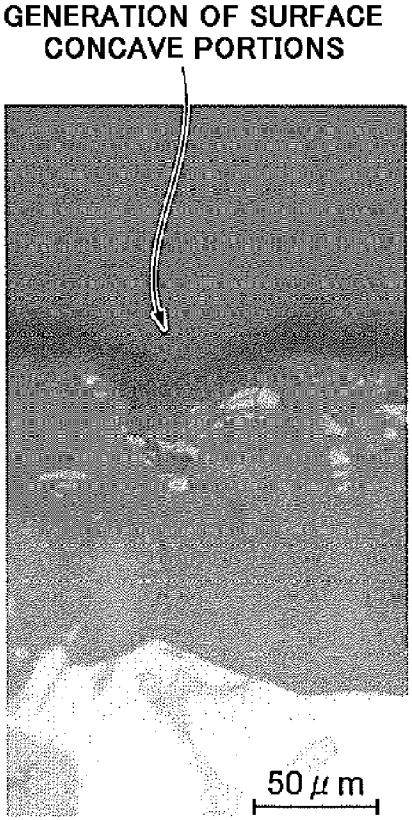
FIG. 8C shows a SEM photograph of a cross-section of thermal insulation film according to a comparative example 2.

Next, observation results regarding the cross-sections of the embodiment and the comparative examples 1 and 2 are examined with reference to FIG. 8. Here, FIGS. 8A-8C are SEM photographs of the cross-section of the thermal insulation film, and respectively are the photograph of the embodiment, the photograph of the comparative example 1 and the photograph of the comparative example 2.

From FIG. 8A, it can be confirmed that in the embodiment, the abrasive powders are accumulated at the concave portions (micro-pores) at the surface of the thermal insulation film. In addition, it can be confirmed from FIG. 8B that in the comparative example 1, there are cracks at the surface of the thermal insulation film, and it can be confirmed from FIG. 8C that in the comparative example 2, there are concave portions (micro-pores) kept in porous state at the surface of the thermal insulation film. Next, measurement results regarding the hardness are shown in Table 3 below and FIG. 9.

TABLE 3

| | Hardness of Anode oxidation coating film + protection film (polysilazane) (Hv0.025 kg) | Hardness of Abrasive powders + protection film (polysilazane) (Hv0.025 kg) |
|---|---|---|
| Embodiment | 420 | 400 |
| Comparative example 1 | 430 | — |
| Comparative example 2 | 410 | — |
| Reference Hardness of anode oxidation coating film | 220 | — |

Figure 9:
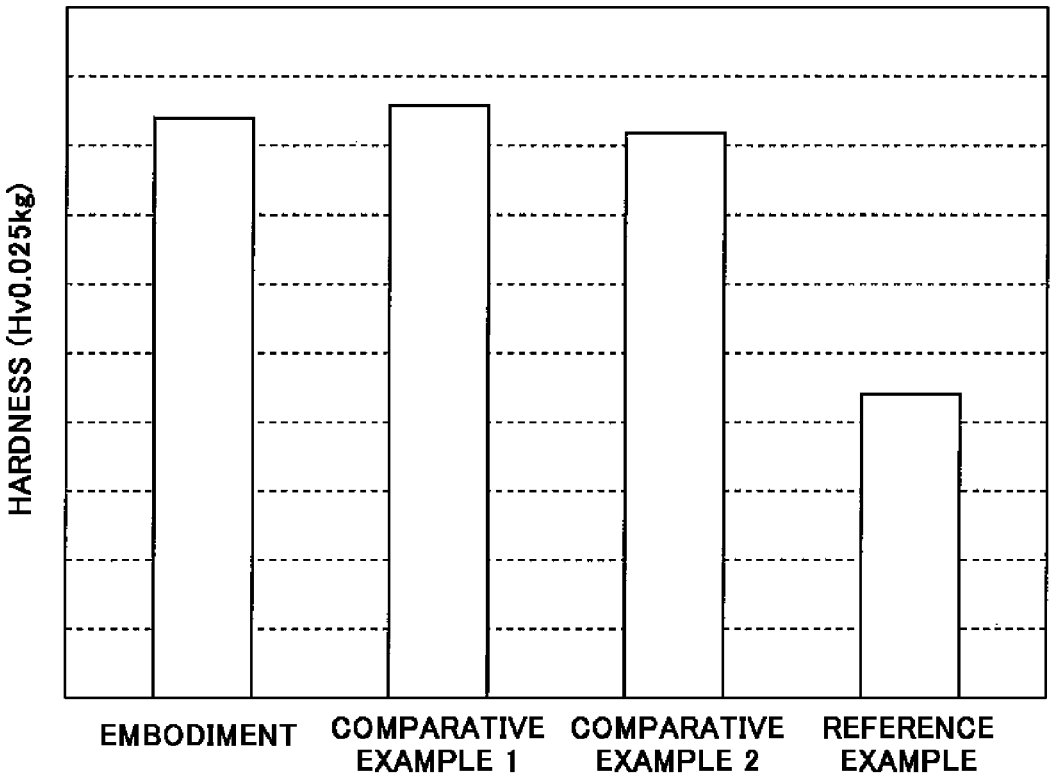
FIG. 9 is a graph showing experiment results of measuring hardness of the thermal insulation film.
Figure 10:
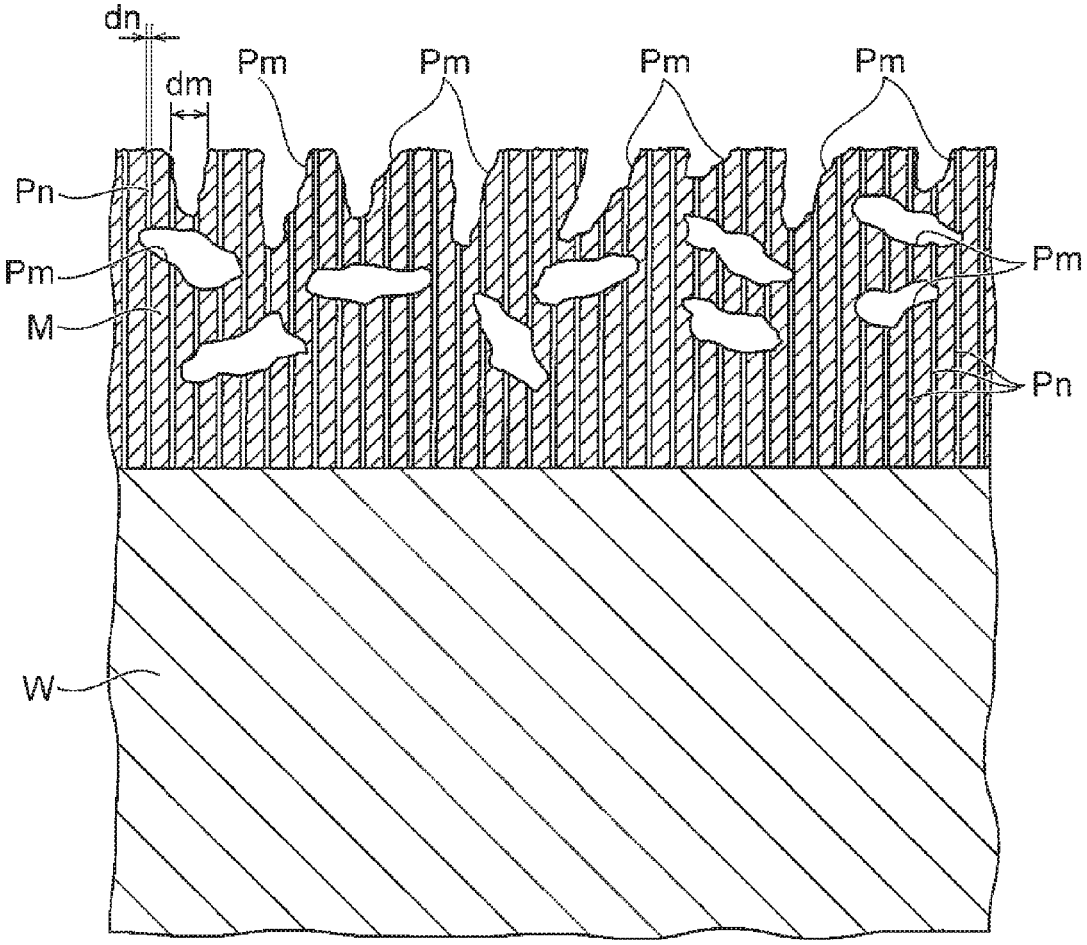
FIG. 10 is a schematic diagram illustrating a conventional forming method of thermal insulation film.
Figure 11:
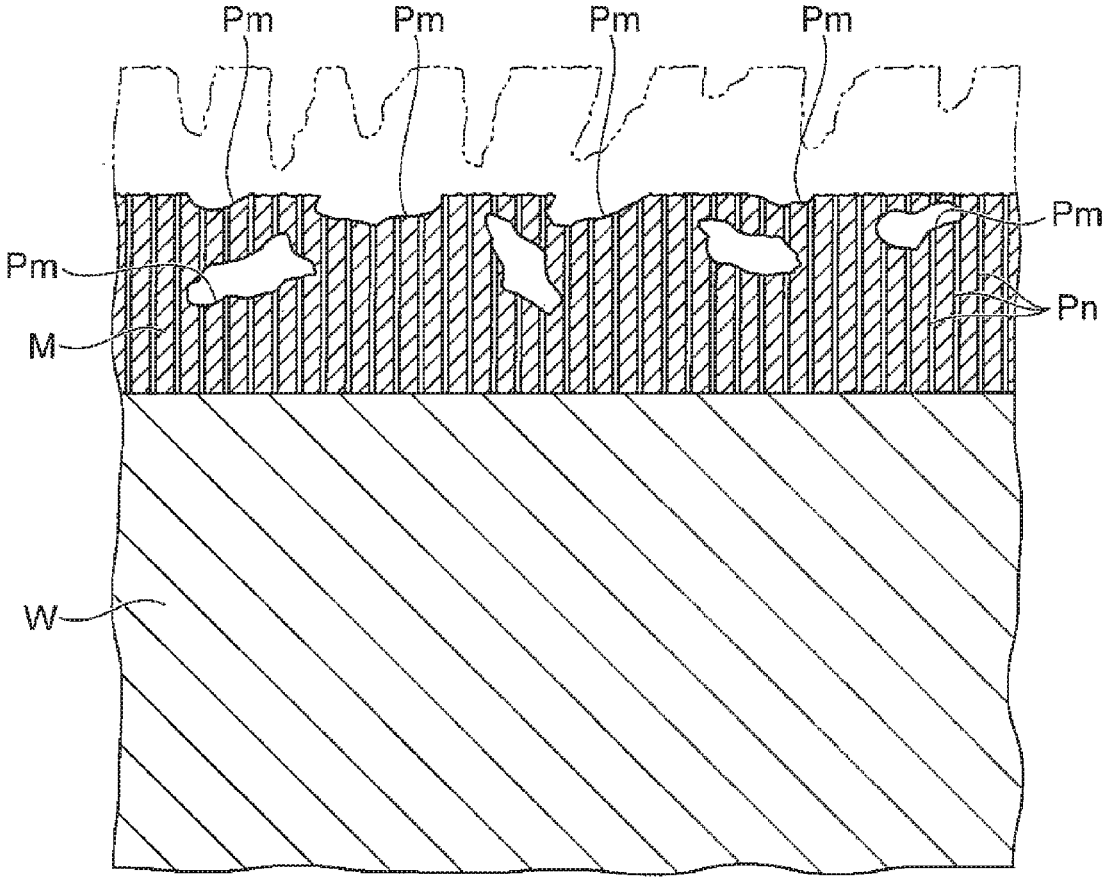
FIG. 11 is a schematic diagram illustrating the conventional forming method of thermal insulation film subsequent to FIG. 10.

From Table 3 and FIG. 9, it is proved that in the embodiment, even the state where the abrasive powders enter the micro-pores at the abraded surface would not hinder the polysilazane from permeating into the micro-pores, and therefore the same hardness is obtained as in the comparative examples 1 and 2.

Embodiments of the invention have been described above with reference to the accompanying drawings, nevertheless the specific constructions are not limited to the embodiments, and design modifications without departing from the scope of gist of the invention are also included in the invention.

What is claimed is:

1. A forming method of a thermal insulation film, comprising:

a first step of forming an anode oxidation coating film on an aluminum-based wall surface, the anode oxidation coating film including micro-pores each having a diameter of micrometer-scale and nano-pores each having a diameter of nanometer-scale;

a second step of abrading a surface of the anode oxidation coating film with abrasive powders to a prescribed depth to form an abraded surface and bringing the abrasive powders into the micro-pores located at the abraded surface; and a third step of forming a protection film on the abraded surface to produce a thermal insulation film including the anode oxidation coating film and the protection film, wherein the abrading reduces a thickness of the anode oxidation coating film in a direction from the surface of the anode oxidation coating film toward the aluminum-based wall surface.

2. The forming method of a thermal insulation film according to claim 1, wherein the micro-pores at the abraded surface formed in the second step have a depth in a range from 1 to 10 μm, and the abrasive powders have an average particle size in a range below 1 μm.

3. The forming method of a thermal insulation film according to claim 2, wherein the average particle size of the abrasive powders is above 100 nm.

4. The forming method of a thermal insulation film according to claim 1, wherein in the third step, a polymer containing Si is coated on the abraded surface, and is fired to be converted into silicon dioxide, so as to form the protection film.

5. The forming method of a thermal insulation film according to claim 1, wherein the abrasive powders brought into the micro-pores are adhered to each other by the protection film.

6. The forming method of a thermal insulation film according to claim 1, wherein the aluminum-based wall surface is a wall surface of a combustion chamber of an internal combustion engine.

7. The forming method of a thermal insulation film according to claim 1, wherein the reduction of the thickness is in the order of micrometers.

* * * * *